US010274272B1

(12) United States Patent
Owensby

(10) Patent No.: US 10,274,272 B1
(45) Date of Patent: Apr. 30, 2019

(54) FIREARM SLIDE ASSIST DEVICEOMA 4260

(71) Applicant: Mark A. Owensby, Pocahontas, IL (US)

(72) Inventor: Mark A. Owensby, Pocahontas, IL (US)

( * ) Notice: Subject to any disclaimer, the term of this patent is extended or adjusted under 35 U.S.C. 154(b) by 0 days.

(21) Appl. No.: 16/117,747

(22) Filed: Aug. 30, 2018

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41A 35/06; F41C 27/00
USPC ..... 89/1.4, 1.42; 42/90, 106
See application file for complete search history.

(56) References Cited

U.S. PATENT DOCUMENTS 1,680,186 A * 8/1928 Von Frommer ..... F41A 3/66 42/106
1,989,448 A * 1/1935 Hasselmann ..... F41A 3/72 42/106
2,505,517 A * 4/1950 Banks ..... B67B 7/162 81/3.44
3,265,032 A * 8/1966 Hume ..... B63B 21/08 114/218
4,702,144 A * 10/1987 Zedrosser ..... F41A 3/72 89/1.4
4,823,671 A * 4/1989 Buryta ..... F41A 3/72 42/106
4,827,652 A * 5/1989 Martin ..... F41A 3/72 42/111
4,843,687 A * 7/1989 Kroepelin, Jr. ..... F16G 11/106 24/134 P
4,995,295 A * 2/1991 Floyd ..... B67B 7/18 7/156
5,852,853 A * 12/1998 Pennoyer, Jr. ..... D06F 53/00 24/134 P
6,019,018 A * 2/2000 Wilson ..... B24B 45/003 81/3.44
6,178,604 B1 * 1/2001 Pennoyer, Jr. ..... D06F 53/005 24/134 P
6,505,384 B1 * 1/2003 Renton ..... B63B 21/04 114/218
6,722,303 B2 * 4/2004 Lob ..... B63B 21/08 114/218
6,857,381 B2 * 2/2005 Siewert ..... F16G 11/106 114/218
8,156,854 B2 * 4/2012 Brown ..... F41A 3/72 89/1.4
8,348,774 B2 * 1/2013 Takabe ..... F16J 3/042 464/111
8,438,774 B2 5/2013 Sharp et al.
8,549,785 B2 10/2013 Sharp et al.
9,121,662 B1 * 9/2015 Love ..... F41C 27/00
9,194,636 B2 11/2015 McAninch
9,500,439 B1 * 11/2016 Dietrich ..... F41A 3/72
9,523,545 B1 * 12/2016 Weller ..... F41C 33/0281
9,733,043 B1 * 8/2017 Cohen ..... F41C 27/00
9,995,544 B1 * 6/2018 Akimov ..... F41A 3/72
(Continued)

*Primary Examiner* — Joshua E Freeman
*Assistant Examiner* — Bridget A Cochran
(74) *Attorney, Agent, or Firm* — Grace J. Fishel

(57) ABSTRACT

A firearm slide assist device is disclosed with a handle having a grasping end and a cam end with an upper tine and a lower tine. The firearm slide assist device further includes a securing arm for connection to the cam end, and a fastening device for fastening the securing arm within the upper tine and the lower tine of the cam end.

20 Claims, 4 Drawing Sheets

(56) References Cited

U.S. PATENT DOCUMENTS 10,054,380 B1* 8/2018 Walters ..... F41A 9/83
2003/0075037 A1* 4/2003 Hogmoe ..... F41C 33/008 89/1.42
2007/0137003 A1* 6/2007 Zebe, Jr. ..... A43C 7/04 24/134 P
2011/0010978 A1* 1/2011 Hooks ..... F41A 17/46 42/69.01
2011/0088539 A1* 4/2011 Oz ..... F41A 19/34 89/1.4
2011/0154710 A1* 6/2011 Hatfield ..... F41A 19/34 42/90
2011/0283587 A1* 11/2011 Sharp ..... F41C 33/0281 42/90
2012/0198744 A1* 8/2012 Meller ..... F41A 3/72 42/90
2013/0081318 A1* 4/2013 Morando ..... F41A 35/00 42/108
2013/0111799 A1* 5/2013 Lee ..... F41C 27/00 42/106
2013/0180152 A1* 7/2013 Speroni ..... F41C 27/00 42/99
2013/0255478 A1* 10/2013 McAninch ..... F41A 7/00 89/1.4
2014/0298703 A1* 10/2014 Gale ..... F41C 27/00 42/71.02
2015/0121734 A1* 5/2015 Kresser ..... F41A 3/72 42/16
2015/0184959 A1* 7/2015 Parnell ..... F41A 7/00 89/1.4
2015/0354909 A1* 12/2015 Tarantino ..... F41A 3/72 89/1.4
2016/0061562 A1* 3/2016 Braun ..... F41A 3/72 42/111
2016/0102938 A1* 4/2016 Sroufe ..... F41A 3/72 42/16
2017/0321977 A1* 11/2017 Teitel ..... F41A 3/72

* cited by examiner

FIREARM SLIDE ASSIST DEVICEOMA 4260

BACKGROUND OF THE INVENTION

Field of the Invention

This disclosure relates generally to a firearm auxiliary device, and more particularly to a firearm slide assist device to aid a gun owner in racking a slide of a firearm.

Brief Description of the Prior Art

This disclosure relates generally to a firearm auxiliary device, and more particularly to a firearm slide assist device to aid a gun owner in racking a slide of a firearm.

Automatic or semiautomatic firearms, such as a pistol, are loaded with rounds or bullets through the use of a magazine. The magazine is inserted into a grip or a handle of the firearm. Once the magazine is inserted a topmost round needs to be moved from the magazine into a firing chamber of the firearm. In order to move the round into the firing chamber the firearm must be operated manually by racking a slide. Movement of the slide is accomplished by an individual grasping the sides of the slide and pushing or pulling the slide as shown in FIG. 8. Racking or moving the slide causes a round to be chambered and a firing pin to be cocked. Once a round is in the chamber the firearm is ready to be fired by pulling a trigger, if a safety is not engaged. The racking operation may be required every time a new magazine is inserted. Racking the slide may require a great deal of force. Some potential users may not have the hand strength required to successfully rack a slide. If the slide is not racked properly then this could be dangerous in that the firearm could accidentally discharge. There are other situations which may require racking the slide other than loading the firearm. For example, in the case of a misfire the defective round or casing must be removed from the firing chamber or in the case of a jam or in the case of the firearm being unloaded by removing a live round from the firing chamber. Also, if the firearm is being used to defend the individual and the individual is not able to rack the slide quickly then the individual may not be able to effectively defend against an attack.

BRIEF SUMMARY OF THE INVENTION

The present disclosure is designed to obviate and overcome many of the disadvantages and shortcomings experienced with racking a slide of a firearm. Moreover, the present disclosure is related to a firearm slide assist device which easily overcomes a force required to rack a slide of a firearm. Further, the firearm slide assist device of the present disclosure is easy to mount onto the slide of a firearm and use and may be removed from the slide after use.

In one form of the present disclosure, a firearm slide assist device is disclosed which comprises a handle having a grasping end and a cam end with the cam end having an upper tine and a lower tine, a securing arm for connection to the cam end, and a fastening device for fastening the securing arm within the upper tine and the lower tine of the cam end.

In another form of the present disclosure, a firearm slide assist device comprises a handle having a grasping end and a cam end with the cam end having an upper tine having an aperture and a lower tine having an aperture, a securing arm being inserted between the upper tine and the lower tine for connection to the cam end, the securing arm having a vertical leg and a horizontal leg with the horizontal leg having an adjustment slot, and a fastening device for fastening the securing arm within the upper tine and the lower tine of the cam end.

In still another form of the present disclosure, a firearm slide device comprises a handle having a grasping end and a cam end with the cam end having an upper tine having an aperture and a lower tine having an aperture with the aperture in the lower tine being recessed into the cam end, a securing arm being inserted between the upper tine and the lower tine for connection to the cam end, the securing arm having a lower vertical leg and an upper horizontal leg, and a fastening device for fastening the securing arm within the upper tine and the lower tine of the cam end.

In light of the foregoing comments, it will be recognized that the firearm slide assist device of the present disclosure is of simple construction and design and which can be easily employed with highly reliable results.

The present disclosure provides a firearm slide assist device that may be used to allow a gun owner to easily rack a slide of a firearm.

The present disclosure provides a firearm slide assist device that may be mounted or positioned on a firearm without having to retrofit or reconfigure the firearm.

The present disclosure provides a firearm slide assist device that can be operated manually to rack a slide of a firearm.

The present disclosure is directed to a firearm slide assist device that can be quickly mounted on a slide of a firearm and quickly removed from the slide of the firearm.

The present disclosure also provides a firearm slide assist device that enhances the strength or leverage of an individual to more easily rack a slide of a firearm.

The present disclosure further provides a firearm slide assist device that is compact and may easily be carried, stored, transported, inventoried, and operated.

The present disclosure provides a firearm slide assist device that can be constructed using readily available materials.

The present disclosure also provides a firearm slide assist device that does not require any special tools to mount the device to a slide of a firearm.

The present disclosure is also directed to a firearm slide assist device which provides enhanced mechanical leverage in racking a slide of a firearm.

The present disclosure also provides a firearm slide assist device which allows an individual to safely and forcefully manipulate a slide of a firearm.

These and other advantages of the present disclosure will become apparent after considering the following detailed specification in conjunction with the accompanying drawings.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
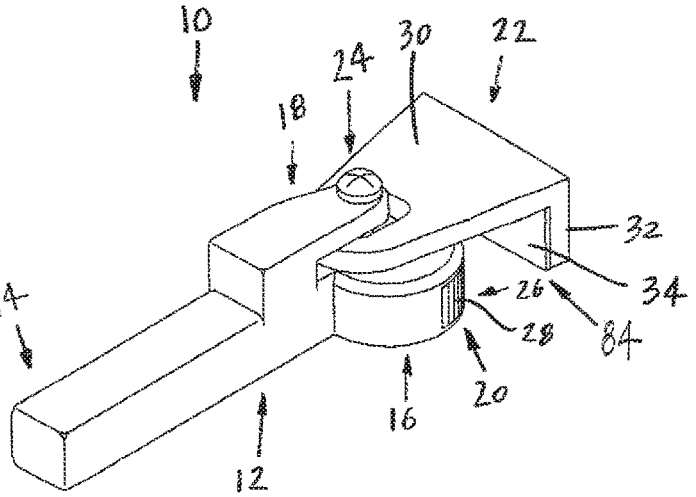
FIG. 1 is a perspective view of a firearm slide assist device constructed according to the present disclosure.

Referring now to the drawings, wherein like numbers refer to like items, number 10 identifies a preferred embodiment of a firearm slide assist device constructed according to the present disclosure. With reference now to FIG. 1, the firearm slide assist device 10 is shown to comprise a handle 12 having a grasping end 14 and a cam end 16 with the cam end 16 having an upper tine 18 and a lower tine 20. A securing arm 22 is connected to the cam end 16 by use of a fastening device 24. The grasping end 14 is generally rectangular in configuration, but other shapes such as oval or round are also possible. The cam end 16 has a cam surface 26 having a serrated face portion 28. The securing arm 22 is generally L-shaped having an upper horizontal leg 30 and a lower vertical leg 32. The lower vertical leg 32 has an interior gripping surface 34 illustrated as a resilient pad or alternatively rubber grommets 35.

Figure 2:
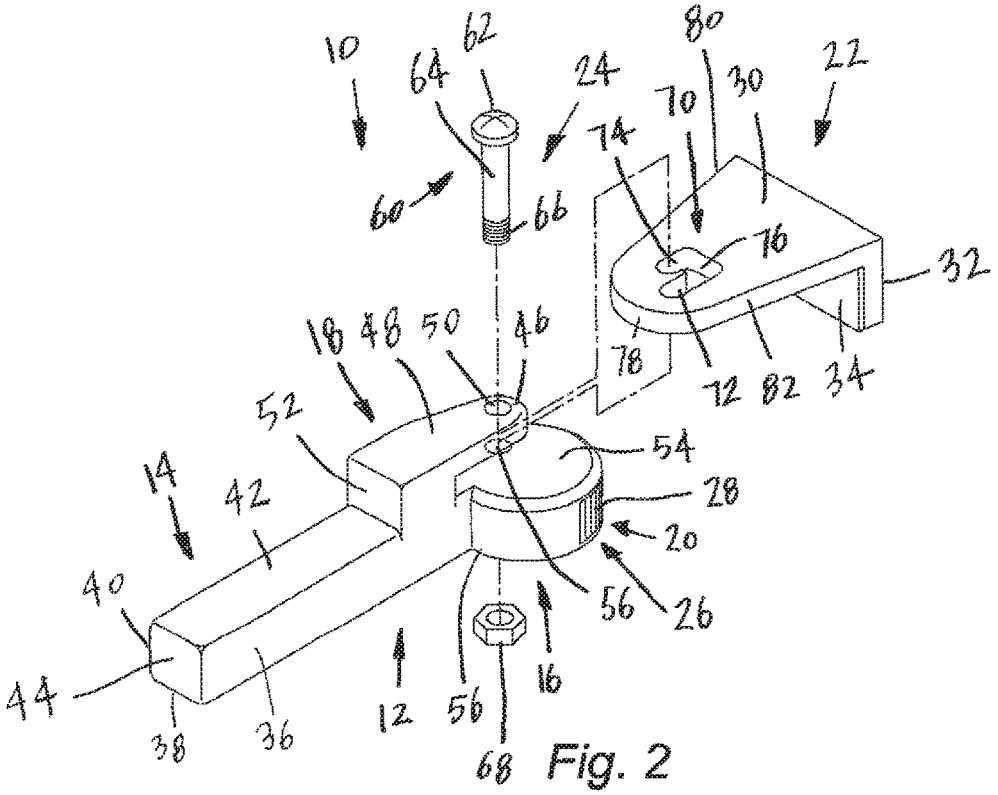
FIG. 2 is an exploded view of the firearm slide assist device constructed according to the present disclosure.

FIG. 2 illustrates an exploded view of the firearm slide assist device 10. The firearm slide assist device is shown having the handle 12 having the grasping end 14 having a first side 36, a bottom side 38, a second side 40, a top side 42, and an end portion 44. The grasping end 14 is used for an individual to easily grasp or hold the device 10 during use. The cam end 16 has the upper tine 18 having a rounded end 46 having an upper surface 48 and an aperture 50 formed in the upper surface 48. The upper tine 18 also has a stop or guard surface 52 that protects an individual's fingers or hand from coming into contact with a slide of a firearm during use. The lower tine 20 has an upper side 54 having an aperture 56 formed there through. The lower tine 20 also has the cam surface 26 having the serrated face portion 28 and a bottom side 58. As can be appreciated, the apertures 50 and 56 are used to receive the fastening device 24. The fastening device 24 may comprise a screw or a bolt 60 having a head 62, a smooth shank portion 64, and a screw end 66. A nut 68 may be attached to the screw end 66.

The securing arm 22 has an adjustment slot 70 formed in the upper horizontal leg 30. The adjustment slot 70 is generally U-shaped with there being a longer leg 72, a shorter leg 74, and a central leg 76 between the legs 72 and 74. The upper horizontal leg 30 has a rounded end 78, a first slanted or angled side 80, and a second slanted or angled side 82. The angled sides 80 and 82 end at the lower vertical leg 32. The upper horizontal leg 30 of the securing arm 22 is adapted to being inserted in between the upper tine 18 and the lower tine 20 and secured in place by the fastening device 24. The smooth shank portion 64 of the bolt 60 allows the securing arm 22 to move within the tines 18 and 20 of the handle 12. The rounded end 78 also allows the securing arm 22 to move within the tines 18 and 20. When the securing arm 22 is inserted in between the tines 18 and 20 and the fastening device 24 is in the longer leg 72 of the adjustment slot 70 there is a first space provided between the gripping surface 34 and the cam surface 26. Also, when the securing arm 22 is inserted in between the tines 18 and 20 and the fastening device 24 is in the shorter leg 74 there is a second space 84 (FIG. 1) that is provided between the gripping surface 34 and the cam surface 26. As can be appreciated, the second space 84 is less than the first space. The adjustment slot 70 is used to mount the device 10 on different width sized firearms. The upper horizontal leg 30 The securing arm 22 also has the lower vertical leg 32 having the interior gripping surface 34.

Figure 3:
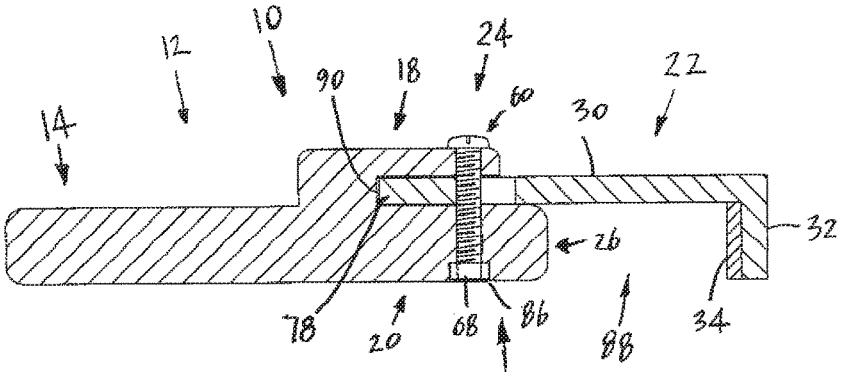
FIG. 3 is a partial cross-sectional view of the firearm slide assist device constructed according to the present disclosure.

With reference now to FIG. 3, a cross-sectional view of the firearm slide assist device 10 is shown. The device 10 has the handle 12 having the grasping end 14 and the cam end 16 with the cam end 16 having the upper tine 18 and the lower tine 20. The securing arm 22 is connected to the cam end 16 by use of the fastening device 24. The lower tine 20 has a recessed portion 86 provided in the lower tine 20 to receive the nut 68 of the fastening device 24. The nut 68 is secured or fastened to the bolt 60 which secures the securing arm 22 within the tines 18 and 20. The cam end 16 has the cam surface 26. The securing arm 22 has the upper horizontal leg 30 and the lower vertical leg 32. The lower vertical leg 32 has the interior gripping surface 34 which may, by way of example only, be a portion of rubber that is adhered to the leg 32. A space 88 is provided between the gripping surface 34 and the cam surface 26. This space 88, which has been referred to above as the first space, occurs when the securing arm 22 is inserted in between the tines 18 and 20 and the fastening device 24 is in the longer leg 72 (FIG. 2) of the adjustment slot 70 (FIG. 2). The upper tine 18 also has a back wall 90. Due to the rounded end 78, the securing arm 22 will not contact the back wall 90 and the securing arm 22 will be free to pivot or move within the tines 18 and 20.

Figure 4:
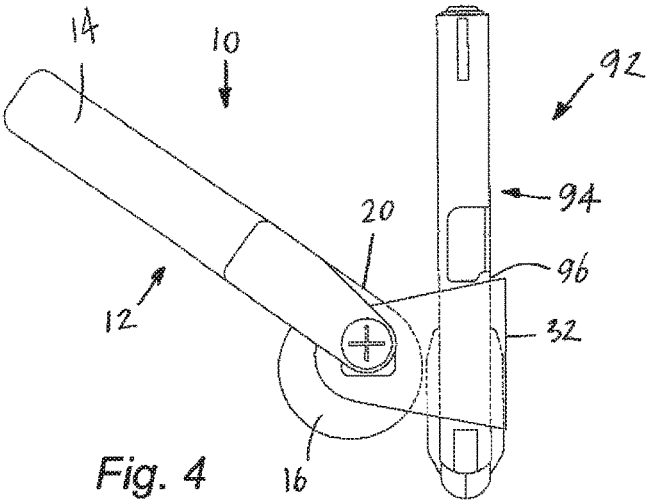
FIG. 4 is a top view of the firearm slide assist device being mounted on a firearm with a slide of the firearm being in an initial position in which the firearm is not yet moved or racked.

FIG. 4 shows the firearm slide assist device 10 being mounted or positioned on a firearm 92 having a slide member 94. The device 10 is in an initial position in which the firearm 92 is not yet racked. The lower vertical leg 32 is gripping a side 96 of the slide member 94. The handle 12 and the lower tine 20 are generally P-shaped in that the cam end 16 is offset from the grasping end 14.

Figure 5:
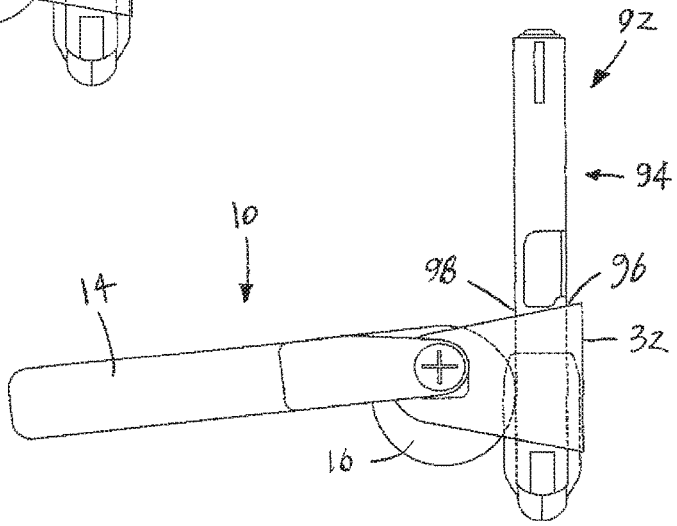
FIG. 5 is a top view of the firearm slide assist device being mounted on a firearm with a slide of the firearm being in a racked position.

With reference now to FIG. 5, the firearm 92 is shown being ready to rack the slide member 94. The grasping end 14 has been moved so that the cam end 16 has been placed against a side 98 of the slide member 94. This secures both the vertical leg 32 against the side 96 and the cam end 16. Although not shown, the serrated face portion 28 provides a firm grip against the side 98.

Figure 6:
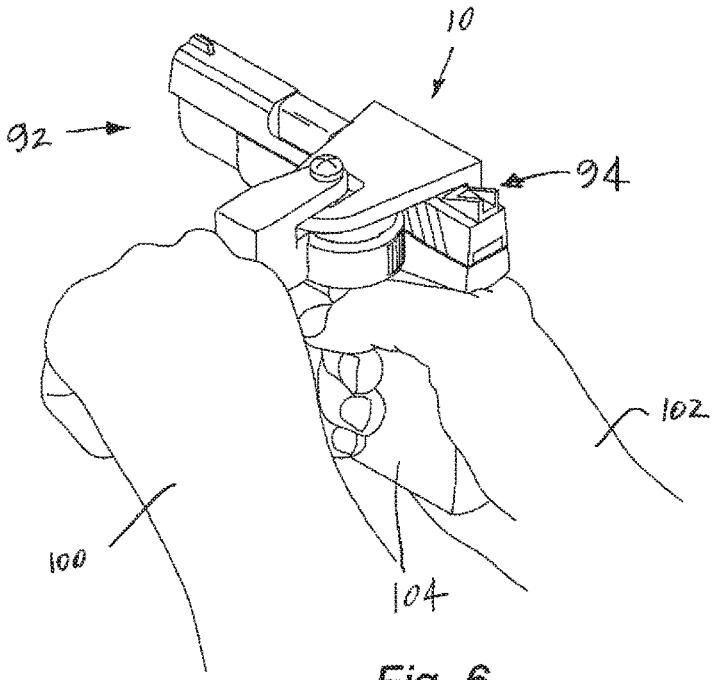
FIG. 6 is a perspective view of the firearm slide assist device being mounted on a firearm with an individual grasping the firearm slide assist device and the firearm being in an initial position in which the firearm is not yet moved or racked.

FIG. 6 illustrates the firearm slide assist device 10 in the same position as that shown in FIG. 5, but with the addition of an individual's left hand 100 grasping the grasping end 14 and a right hand 102 grasping a grip 104 of the firearm 92. The device 10 is securely positioned on the firearm 92 and the slide member 94 is ready to be racked.

Figure 7:
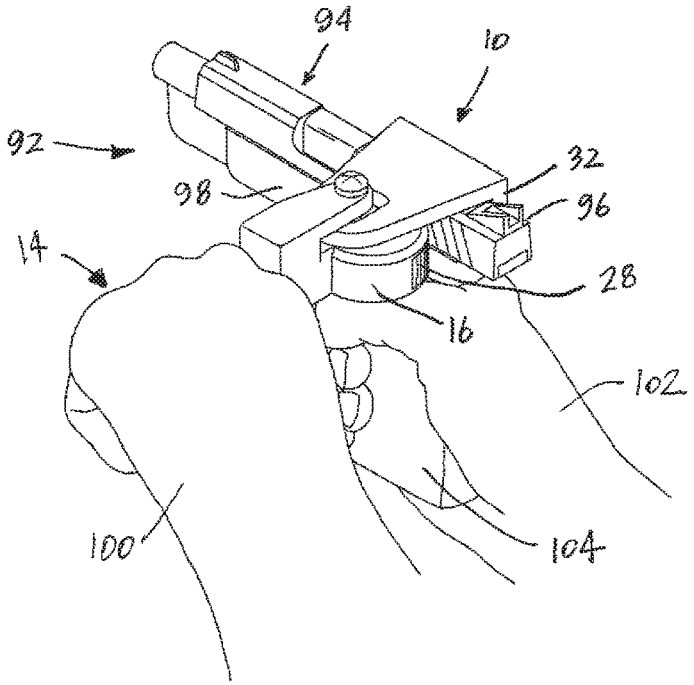
FIG. 7 is another perspective view of the firearm slide assist device being mounted on a firearm with an individual grasping the firearm slide assist device with a slide of the firearm being in a racked position.
Figure 8:
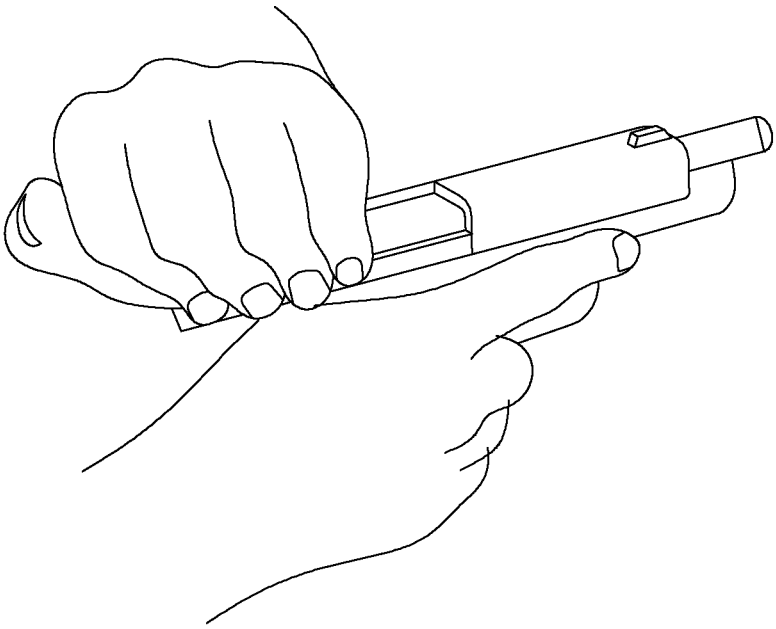
PRIOR ART Fig. 8
FIG. 8 is a prior art view of a firearm slide being manually racked by grasping the slide between the fingers of a user's left hand.

Referring now to FIG. 7, the firearm 92 is shown being racked. The firearm 92 is racked by moving the grip 104 by use of the right hand 102 forward and holding on to the grasping end 14 which is obscured by the left hand 100. The cam end 16 has provided leverage for the firearm 92 to be easily racked. In particular, the cam end 16 has pressed against the side 98 of the slide member 94 and the vertical leg 32 has remained secured to the side 96. The cam end 16 provides enough leverage to be able to easily rack the firearm 92 when moving the firearm 92 forward with the right hand 102.

From all that has been said, it will be clear that there has thus been shown and described herein a firearm slide assist device which fulfills the various objects and advantages sought therefor. It will be apparent to those skilled in the art, however, that many changes, modifications, variations, and other uses and applications of the subject firearm slide assist device are possible and contemplated. All changes, modifications, variations, and other uses and applications which do not depart from the spirit and scope of the disclosure are deemed to be covered by the disclosure, which is limited only by the claims which follow.

What is claimed:

1. A firearm slide assist device comprising: a handle having a grasping end and a cam end with the cam end having an upper tine and a lower tine; a securing arm being inserted between the upper tine and the lower tine for connection to the cam end; and a fastening device for fastening the securing arm within the upper tine and the lower tine of the cam end; wherein said firearm slide assist device is configured to attach to a firearm such that the cam end provides enough leverage to easily rack the firearm.

2. The firearm slide assist device of claim 1 wherein the cam end further comprises a cam surface having a serrated face portion.

3. The firearm slide assist device of claim 1 wherein the securing arm further comprises an upper horizontal leg and a lower vertical leg.

4. The firearm slide assist device of claim 3 wherein the lower vertical leg further comprises an interior gripping surface.

5. The firearm slide assist device of claim 3 wherein the upper horizontal leg further comprises an aperture for receiving there through the fastening device.

6. The firearm slide assist device of claim 3 wherein the upper horizontal leg further comprises a rounded end.

7. The firearm slide assist device of claim 1 wherein the grasping end is generally rectangular in shape and the upper tine has a guard surface.

8. A firearm slide assist device comprising: a handle having a grasping end and a cam end with the cam end having an upper tine having an aperture and a lower tine having an aperture; a securing arm being inserted between the upper tine and the lower tine for connection to the cam end, the securing arm having a lower vertical leg and an upper horizontal leg with the horizontal leg having an adjustment slot; and a fastening device for fastening the securing arm within the upper tine and the lower tine of the cam end; wherein said firearm slide assist device is configured to attach to a firearm such that the cam end provides enough leverage to easily rack the firearm.

9. The firearm slide assist device of claim 8 wherein the adjustment slot comprises a generally U-shaped slot having a longer leg, a shorter leg, and a central leg between the legs.

10. The firearm slide assist device of claim 9 wherein the adjustment slot allows the securing arm to be positioned in a first position in the longer leg and a second position in the shorter leg.

11. The firearm slide assist device of claim 9 wherein when the securing arm is positioned in the longer leg a first space is provided between the lower vertical leg and the cam end and when the securing arm is positioned in the shorter leg a second space is provided between the lower vertical leg and the cam end.

12. The firearm slide assist device of claim 8 wherein the cam end further comprises a cam surface having a serrated face portion.

13. The firearm slide assist device of claim 8 wherein the upper horizontal leg further comprises a rounded end.

14. The firearm slide assist device of claim 8 wherein the fastening device comprises a bolt having a head, a smooth shank portion, a screw end, and a nut for attachment to the screw end.

15. A firearm slide assist device comprising: a handle having a grasping end and a cam end with the cam end having an upper tine having an aperture and a lower tine having an aperture with the aperture in the lower tine being recessed into the cam end; a securing arm being inserted between the upper tine and the lower tine for connection to the cam end, the securing arm having a lower vertical leg and an upper horizontal leg; and a fastening device for fastening the securing arm within the upper tine and the lower tine of the cam end; wherein said firearm slide assist device is configured to attach to a firearm such that the cam end provides enough leverage to easily rack the firearm.

16. The firearm slide assist device of claim 15 wherein the cam end further comprises a cam surface having a serrated face portion.

17. The firearm slide assist device of claim 8 wherein the fastening device comprises a bolt having a head, a smooth shank portion, a screw end, and a nut for attachment to the screw end with the nut fitting into the recessed aperture in the lower tine of the cam end.

18. The firearm slide assist device of claim 15 wherein the lower vertical leg further comprises an interior gripping surface.

19. The firearm slide assist device of claim 15 wherein the grasping end is generally rectangular in shape and the upper tine has a guard surface.

20. The firearm slide assist device of claim 15 wherein the upper horizontal leg further comprises a rounded end.

* * * * *